US010280786B2

(12) United States Patent
Harris et al.

(10) Patent No.: US 10,280,786 B2
(45) Date of Patent: May 7, 2019

(54) GROUND-PROJECTILE SYSTEM

(71) Applicant: Leigh Aerosystems Corporation, Carlsbad, CA (US)

(72) Inventors: Stephen L. Harris, Carlsbad, CA (US); Gordon L. Harris, Carlsbad, CA (US)

(73) Assignee: Leigh Aerosystems Corporation, Carlsbad, CA (US)

( * ) Notice: Subject to any disclaimer, the term of this patent is extended or adjusted under 35 U.S.C. 154(b) by 380 days.

(21) Appl. No.: 15/287,362

(22) Filed: Oct. 6, 2016

(65) Prior Publication Data

US 2017/0101884 A1 Apr. 13, 2017

Related U.S. Application Data

(60) Provisional application No. 62/238,929, filed on Oct. 8, 2015.

(51) Int. Cl.

| | |
|---|---|
| ***F01D 5/02*** | (2006.01) |
| ***F01D 15/10*** | (2006.01) |
| ***F01D 25/16*** | (2006.01) |
| ***F01D 25/24*** | (2006.01) |
| ***F42B 10/64*** | (2006.01) |
| ***F42B 15/01*** | (2006.01) |
| ***F42B 30/10*** | (2006.01) |
| ***F42C 11/00*** | (2006.01) |

(52) U.S. Cl.

CPC ..... *F01D 15/10* (2013.01); *F01D 5/02* (2013.01); *F01D 25/16* (2013.01); *F01D 25/24* (2013.01); *F42B 10/64* (2013.01); *F42B 15/01* (2013.01); *F42B 30/10* (2013.01); *F42C 11/008* (2013.01); *F05D 2210/12* (2013.01); *F05D 2240/60* (2013.01)

(58) Field of Classification Search

USPC ..... 290/52, 55; 244/3.1–3.3, 17.11–17.27, 244/58; 180/2.2, 65.21–62.29

See application file for complete search history.

(56) References Cited

U.S. PATENT DOCUMENTS

| | | | | |
|---|---|---|---|---|
| 3,265,329 A | | 8/1966 | Postelson | |
| 3,556,239 A | * | 1/1971 | Spahn | B60K 1/00 180/65.25 |
| 3,868,883 A | | 3/1975 | Tucker | |
| 3,876,925 A | * | 4/1975 | Stoeckert | B60K 16/00 322/1 |
| 4,163,904 A | | 8/1979 | Skendrovic | |

(Continued)

FOREIGN PATENT DOCUMENTS

| | | |
|---|---|---|
| DE | 4335785 A1 | 4/1995 |
| EP | 0506536 B1 | 5/1995 |

(Continued)

*Primary Examiner* — Pedro J Cuevas

(74) *Attorney, Agent, or Firm* — Mintz Levin Cohn Ferris Glovsky and Popeo, P.C.

(57) ABSTRACT

A Projectile Continuous Power Module (PCMP) is configured to take incoming or oncoming airflow of an inflight projectile and direct the airflow to a turbine for converting the airflow into electrical power. The PCMP is mounted within or otherwise coupled to an airframe of the projectile. The PCMP is coupled to the projectile in a manner such that an air inlet of the projectile is positioned to capture incoming or oncoming boundary layer airflow as the projectile travels.

7 Claims, 9 Drawing Sheets

(56) References Cited

U.S. PATENT DOCUMENTS 4,168,759 A * 9/1979 Hull ..... B60K 16/00 180/2.2
4,373,688 A 2/1983 Topliffe
4,423,368 A * 12/1983 Bussiere ..... B60K 16/00 322/35
4,424,042 A * 1/1984 Gongwer ..... B63H 1/28 114/338
4,434,718 A 3/1984 Kopsch et al.
4,438,893 A 3/1984 Sands et al.
4,477,040 A * 10/1984 Karanik ..... B64C 21/04 244/58
4,512,537 A 4/1985 Sebestyen et al.
4,561,611 A 12/1985 Sinclair et al.
4,565,340 A 1/1986 Bains
4,568,039 A 2/1986 Smith et al.
4,587,803 A * 5/1986 Nightingale ..... F02K 3/075 244/12.5
4,917,332 A * 4/1990 Patterson, Jr. ..... B64C 23/065 244/58
5,141,173 A * 8/1992 Lay ..... B60F 5/02 244/2
5,150,859 A * 9/1992 Ransick ..... B64C 23/065 244/58
5,186,420 A 2/1993 Beauchamp et al.
5,235,930 A 8/1993 Pendleton
5,238,204 A 8/1993 Metz
5,297,764 A * 3/1994 Haney ..... B64C 23/065 244/199.3
5,386,146 A * 1/1995 Hickey ..... F03B 3/12 180/2.2
5,393,011 A 2/1995 Dunn et al.
5,452,864 A 9/1995 Alford et al.
5,490,572 A * 2/1996 Tajiri ..... B60H 1/00278 180/65.1
5,505,587 A * 4/1996 Ghetzler ..... B64D 41/007 415/49
5,680,032 A * 10/1997 Pena ..... B60K 6/105 290/52
5,934,612 A * 8/1999 Gerhardt ..... B64C 23/065 244/58
6,138,781 A * 10/2000 Hakala ..... B60K 16/00 180/2.2
6,237,496 B1 5/2001 Abbott
6,270,309 B1 * 8/2001 Ghetzler ..... B64D 41/007 137/15.1
6,373,145 B1 * 4/2002 Hamrick ..... B60K 16/00 290/44
6,695,252 B1 2/2004 Dryer
6,700,215 B2 * 3/2004 Wu ..... B60K 16/00 290/44
6,838,782 B2 * 1/2005 Vu ..... B60K 6/48 290/55
6,857,492 B1 * 2/2005 Liskey ..... B60K 16/00 180/165
6,897,575 B1 * 5/2005 Yu ..... B60K 16/00 290/44
7,412,930 B2 8/2008 Smith et al.
7,475,846 B2 1/2009 Schroeder
7,497,287 B2 * 3/2009 Kunikata ..... B60K 11/02 180/68.1
7,665,554 B1 * 2/2010 Walsh ..... B60K 16/00 180/2.2
7,752,976 B2 7/2010 Banks
7,789,182 B2 * 9/2010 Bradley ..... B60K 16/00 180/165
7,923,671 B1 4/2011 Huguenin et al.
7,963,442 B2 6/2011 Jenkins et al.
7,982,328 B2 * 7/2011 Huntemann ..... B64D 41/007 290/55
8,026,465 B1 9/2011 Fraysse, Jr.
8,113,118 B2 2/2012 Schmidt et al.
8,220,392 B1 7/2012 Maldonado et al.
8,237,096 B1 8/2012 Alexander et al.
8,324,544 B2 12/2012 Palani et al.
8,426,788 B2 4/2013 Geswender
8,434,574 B1 * 5/2013 York ..... F03D 13/10 180/2.2
8,509,992 B1 * 8/2013 Bosworth ..... H02J 7/32 320/101
8,640,589 B2 2/2014 Dryer et al.
8,653,688 B2 * 2/2014 Justak ..... B64D 41/007 290/55
8,674,277 B2 3/2014 Axford et al.
8,678,310 B2 * 3/2014 Masoudipour ..... F02C 7/32 244/53 B
8,710,691 B2 * 4/2014 Haddad ..... B60K 16/00 290/55
8,790,068 B2 7/2014 Cantwell
8,791,588 B2 * 7/2014 Steinlechner ..... F03D 1/065 290/55
8,814,081 B2 * 8/2014 Gagne ..... B64D 27/00 244/118.2
8,911,703 B2 * 12/2014 McAlister ..... B01J 19/20 423/650
8,967,302 B2 * 3/2015 Tran ..... B60K 16/00 180/2.2
9,021,961 B1 5/2015 Manole et al.
9,285,196 B2 3/2016 Harris et al.
9,371,739 B2 * 6/2016 Robinson ..... B64D 41/007
9,546,854 B2 1/2017 Harris et al.
9,670,899 B2 * 6/2017 Steinlechner ..... F03D 1/065
9,745,960 B2 * 8/2017 Dietzel ..... F03D 7/0224
9,828,110 B2 * 11/2017 Roques ..... B64D 41/00
9,957,060 B2 * 5/2018 Riordan ..... B64D 41/007
2001/0039898 A1 11/2001 Bar et al.
2002/0066608 A1 * 6/2002 Guenard ..... B60K 1/00 180/65.22
2002/0153178 A1 * 10/2002 Limonius ..... B60L 8/00 180/2.2
2003/0209370 A1 * 11/2003 Maberry ..... B60K 6/48 180/2.2
2004/0084908 A1 * 5/2004 Vu ..... B60K 6/48 290/55
2005/0029027 A1 * 2/2005 Kunikata ..... B60K 11/02 180/68.1
2005/0098361 A1 * 5/2005 Mitchell ..... B60L 8/006 180/2.2
2005/0151000 A1 7/2005 Dodu et al.
2006/0113118 A1 * 6/2006 Kim ..... B60K 16/00 180/2.2
2007/0089918 A1 * 4/2007 Gonzalez ..... B60K 17/356 180/65.1
2007/0284155 A1 * 12/2007 Cong ..... B60K 16/00 180/2.2
2008/0001023 A1 1/2008 Schroeder
2008/0006736 A1 1/2008 Banks
2008/0169133 A1 * 7/2008 Tomoyasu ..... B60K 16/00 180/2.2
2008/0223977 A1 9/2008 Dryer
2008/0308671 A1 12/2008 Harnoy
2008/0315032 A1 12/2008 Harnoy
2009/0026770 A1 * 1/2009 Huntemann ..... B64D 41/007 290/55
2009/0114763 A1 5/2009 Geck et al.
2009/0133943 A1 * 5/2009 Noguchi ..... B60K 1/04 180/65.21
2010/0147992 A1 6/2010 Mock
2010/0275805 A1 11/2010 Rastegar et al.
2010/0282895 A1 11/2010 Geswender
2011/0033280 A1 * 2/2011 Justak ..... B64D 41/007 415/73
2011/0073705 A1 3/2011 Huguenin et al.
2011/0100731 A1 * 5/2011 Hassan ..... B60L 8/003 180/2.2
2011/0101698 A1 * 5/2011 Saluccio ..... B60L 8/003 290/55
2011/0180655 A1 7/2011 Deschatre
2011/0285886 A1 11/2011 Kato et al.
2011/0297783 A1 12/2011 Martinez

(56) References Cited

U.S. PATENT DOCUMENTS

2012/0006938 A1* 1/2012 Gatzke ..... B64D 41/007 244/58
2012/0048991 A1 3/2012 Frey, Jr.
2012/0160957 A1* 6/2012 Gagne ..... B64D 27/00 244/54
2012/0217338 A1 8/2012 Flood et al.
2012/0248239 A1 10/2012 Geswender et al.
2012/0299558 A1* 11/2012 Justak ..... B64D 41/007 322/28
2012/0301273 A1* 11/2012 Justak ..... B64D 41/007 415/4.3
2013/0048780 A1* 2/2013 Masoudipour ..... B64D 41/007 244/58
2013/0158828 A1* 6/2013 McAlister ..... B01J 19/20 701/70
2013/0248657 A1* 9/2013 Riordan ..... B64D 41/007 244/53 B
2014/0002756 A1 1/2014 Huang et al.
2014/0193236 A1* 7/2014 Robinson ..... F01D 17/02 415/1
2014/0312162 A1 10/2014 Geswender et al.
2015/0128636 A1* 5/2015 McAlister ..... B01J 19/20 62/440
2017/0191809 A1 7/2017 Harris et al.
2017/0219324 A1 8/2017 Harris et al.

FOREIGN PATENT DOCUMENTS

EP 1092941 B1 8/2005
RU 2172462 C2 8/2001
WO WO-2008/010226 A1 1/2008
WO WO-2010/016967 A1 2/2010
WO WO-2010/039322 A2 4/2010

* cited by examiner

GROUND-PROJECTILE SYSTEM

CROSS REFERENCE TO RELATED APPLICATION

This application claims priority under 35 U.S.C. § 119(e) to U.S. Provisional Patent Application Ser. No. 62/238,929, filed Oct. 8, 2015, titled "GROUND-PROJECTILE GUIDANCE SYSTEM, the disclosure of which is hereby incorporated by reference in its entirety.

BACKGROUND

The present disclosure relates to unguided ground-launched projectiles and in particular to a system for accurately powering and/or guiding ground projectiles such as Guided Mortar Bombs (GMBs) and artillery shells. Many entities manufacture such unguided projectiles in various sizes and forms. Armed forces around the world maintain large inventories of these munitions. By their nature, unguided projectiles are "dumb" in that they are not accurately guided to a target. As a result, successful use of such projectiles is largely dependent on the particular skill and experience level of the person launching the projectile.

To overcome these limitations, various schemes for providing automatic guidance to these devices have been developed, including the guidance units described in U.S. Pat. No. 9,285,196 entitled "Ground-Projectile Guidance System" and co-pending U.S. patent application Ser. No. 15/244,431 entitled "Ground-Projectile Guidance System", which are both incorporated herein by reference in their entirety. Once systems as these can accurately guide the munitions to the target, the opportunity arises to enable the munition to achieve greater ranges. This requires longer flight times to achieve, and thereby increases the burden on the device's electrical source to provide power to the guidance and fuzing electronics over this extended period of time

SUMMARY

Many power sources have been used to provide power for projectiles over the years. Such power sources include, for example, active batteries, thermal batteries and different types of projectile spin-driven and air-driven turbine generators. The disclosed system is or can include an air-driven turbine generator.

The disclosed system is configured to supply continuous electrical power to a guided projectile. The system supplies electrical power through a g-hardened vertical axis turbine to a guided projectile's guidance electronics or to another system of the projectile over the flight time of a projectile. The system has no need for and does not necessarily include active batteries that have limited shelf life, thermal batteries that are large and expensive or other systems that rely on a particular property or function of the particular projectile such as spin-stabilization. The system includes a vertical turbine compactly coupled to a generator such as a flat external-armature brushless generator, which is supported by a housing. The housing directs oncoming or incoming airflow into an annular duct or other opening such that the airflow impacts and drives one or more blades of a vertical-axis turbine wheel. The housing also exhausts airflow along a vector that is 90 degrees or substantially 90 degrees to a vector aligned with a direction of flight of the projectile. In addition, the system can utilize turbine wheel speed and delivered power to determine projectile true airspeed.

In one aspect, there is disclosed a power system for a ground-launched projectile, comprising: a ground-launch projectile, the projectile having an outer housing that defines an outer surface, wherein the projectile lacks a battery; a rotatable turbine that rotates about an axis, the turbine having a plurality of blades that radiate outward from a central hub; a power generator inside the turbine, wherein the turbine is attached to the power generator such that the power generator generates power upon rotation of the turbine; an annular bearing that surrounds the power generator, the annular bearing being aligned about the axis; an air inlet in the outer surface of the outer housing, wherein the air inlet directs airflow toward the turbine when the projectile is in flight and wherein the airflow causes the turbine to rotate about the axis; and an air outlet in the outer surface of the outer housing, wherein the air outlet directs exhaust airflow from the turbine out of the outer housing along a direction that is 90 degrees relative to a direction of flight of the projectile.

These features and advantages should be apparent from the following description of various embodiments, which illustrate, by way of example, the principles of the invention.

DETAILED DESCRIPTION

Disclosed herein is a device configured to provide continuous electrical power to an electronic system or other system of a long range guided projectile.

Figure 1:
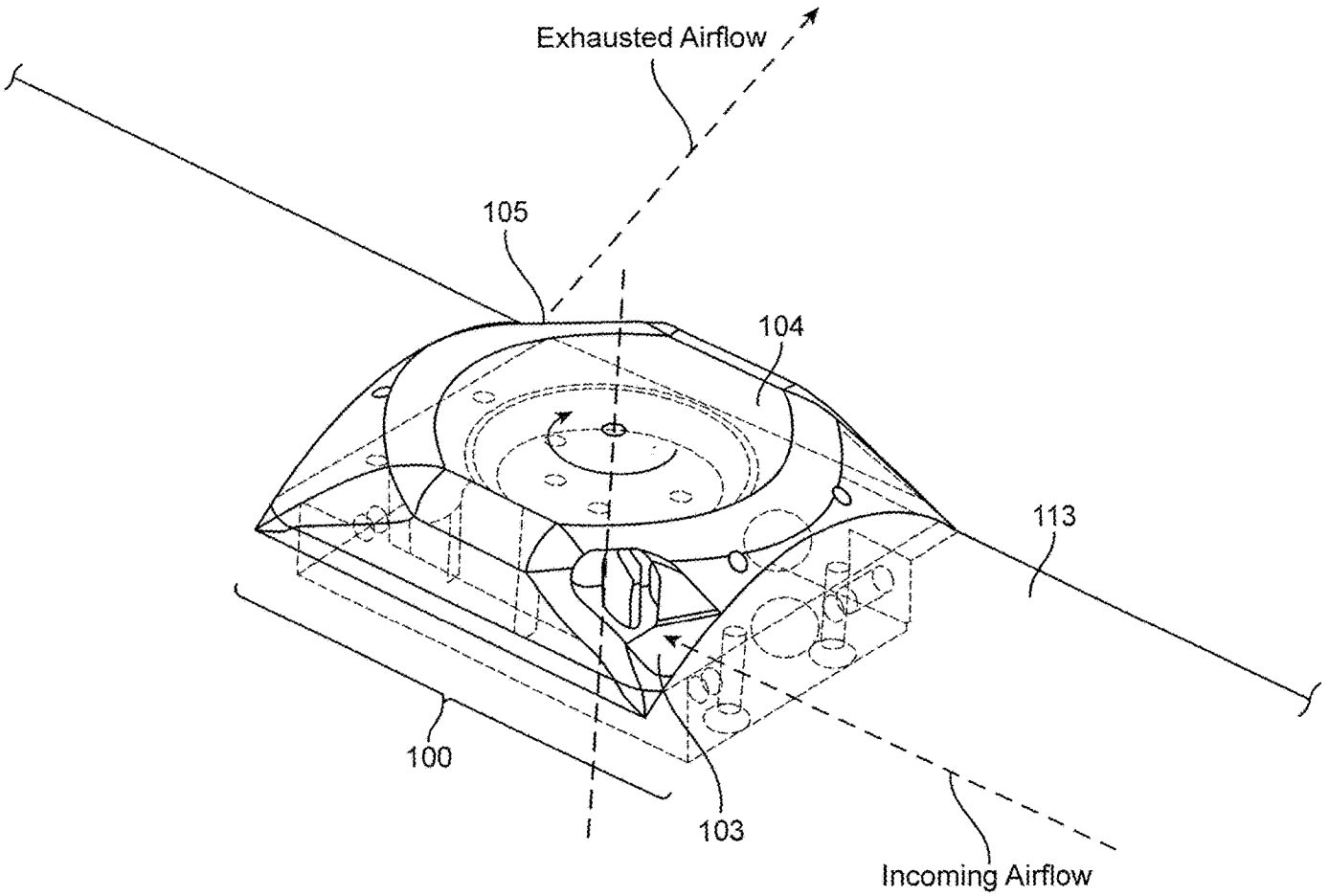
FIG. 1 shows an example embodiment of a portion of a projectile that includes a mechanization of a Projectile Continuous Power Module (PCPM) and a semi-flush inlet of the PCPM.

FIG. 1 shows a first embodiment of a Projectile Continuous Power Module (PCMP) (100). The PCMP is configured to take incoming or oncoming airflow of an inflight projectile and direct the airflow to a turbine for converting the airflow into electrical power. The PCMP is mounted within or otherwise coupled to an airframe of the projectile. The PCMP is coupled to the projectile in a manner such that an air inlet of the projectile is positioned to capture incoming or oncoming boundary layer airflow as the projectile travels.

As mentioned, the oncoming airflow present during the flight of a projectile is converted into electrical power to drive guidance and fuzing functions while imparting a minimal drag increase to the airframe of the projectile. With reference to FIG. 1, the system includes a semi-flush or flush (with respect to an outer surface of an airframe of the projectile) opening or inlet (103) that extends through the airframe of the projectile and/or through a housing of the PCMP. The inlet (103) is an opening that communicates with a turbine wheel (104) that is positioned inside the airframe. The inlet (103) can be coupled to one or more baffles or other structure that guides the airflow from the inlet (103) toward the turbine wheel (104) such that the airflow drives or otherwise interacts with the turbine wheel (104).

Figure 2:
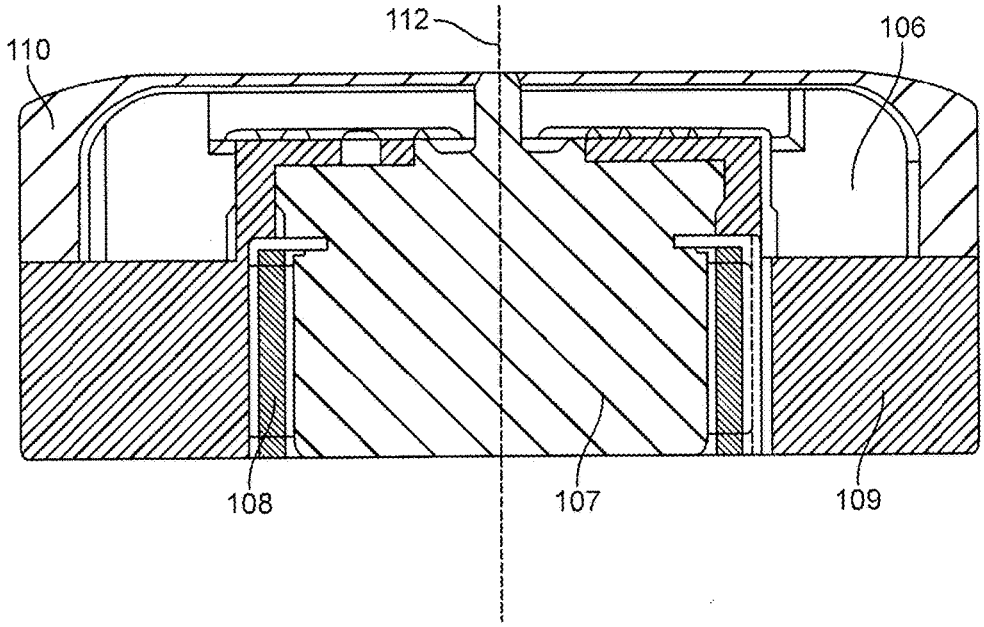
FIG. 2 is a cutaway view of the PCMP shown in FIG. 1.

Thus, the inlet (103) receives the airflow and directs the airflow toward and around the circumference of a turbine wheel (104). The turbine wheel (104) may be surrounded by an annular wall or a turbine baffle that contains and/or guides the airflow around the turbine wheel (104). The turbine baffle is sized and shaped to direct the airflow from the turbine wheel (104) to an exhaust port (105), which is an opening through which the airflow can exit the airframe. In an embodiment, the exhaust port (105) discharges the flow at or along a vector that is 90 degrees or substantially 90 degrees to a direction of flight of the projectile. This further increases the power that the turbine wheel is able to extract from the airflow. Because of its closeness to the surface of a guidance unit body (113), the inlet (103) ingests mostly low energy boundary layer flow, thereby minimizing any drag increment that may be attributed to the PCPM. By measuring the speed of the turbine and the electrical power being delivered by the generation, the true airspeed of the projectile at any point along its trajectory can be determined. This is a valuable parameter to obtain in order to optimize range performance, guidance, control, and navigation of the projectile FIG. 2 shows a cutaway or cross-sectional view of the PCMP showing the turbine wheel. The turbine wheel includes a plurality of blades (106) that radiate outward from a central, hub of the turbine, the hub being aligned with a vertical axis (112) that is co-axial with an axis of rotation of the turbine wheel. The blades (106) wrap around or are positioned around a generator (107) that rotates about the axis (112) around which the blades (106) are arranged. The generator is configured to generate power upon rotation of at least a portion of the generator when drive by the turbine. This arrangement maximizes the aerodynamic surface area and moment arm of each blade in order to produce as much torque and rotational velocity as possible from the oncoming flow for the given available volume and airspeed. FIG. 2 also shows a bearing (108), such as an annular bearing, that is positioned in concert with a lower housing (109) that entirely or partially surrounds the turbine blades (106). The bearing may be rotatable about the axis (112). The bearing (108) and the housing (109) both surround in an annular fashion the turbine blades and the generator and are co-axial with the axis (112). The lower housing (109) is positioned around and protects an armature and motor shaft of the generator from bending or otherwise deforming about the vertical axis (112) during a high-g setback (firing) event.

Figure 3:
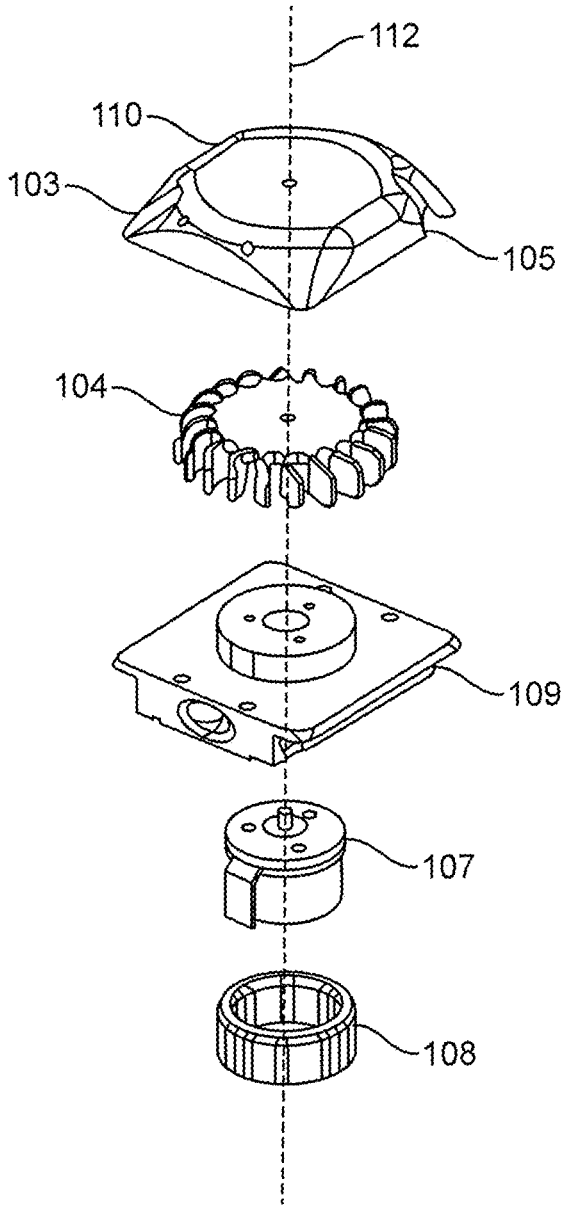
FIG. 3 is an exploded view of the PCMP shown in FIG. 1.

FIG. 3 shows an exploded view of the PCPM. As mentioned, the PCPM includes an upper housing (110) which defines a top region or boundary of the PCPM. The upper housing (110) can be flush with an outer surface of a projectile in which the PCMP is mounted. The upper housing (110) includes the flush or semi-flush inlet (103) and also includes the exhaust port (105), which as mentioned directs exhaust at an angle that is 90 degrees to a direction of flight when the projectile is in motion.

With reference still to FIG. 3, the PCPM further includes the rotatable turbine wheel (104), which has a central hub about which a plurality of blades radiate outward. The turbine wheel (104) rotates about the vertical axis (112) and drives an external-armature "flat" brushless electrical generator (107). In this regard, the turbine wheel may be attached to a drive shaft of the generator (107) such that rotation of the turbine drives the drive shaft to also rotate. The generator (107) is surrounded by a bearing (108) cased in a lower housing (109) in order to protect it from the extreme inertial loads experienced during the firing event.

Figure 4A:
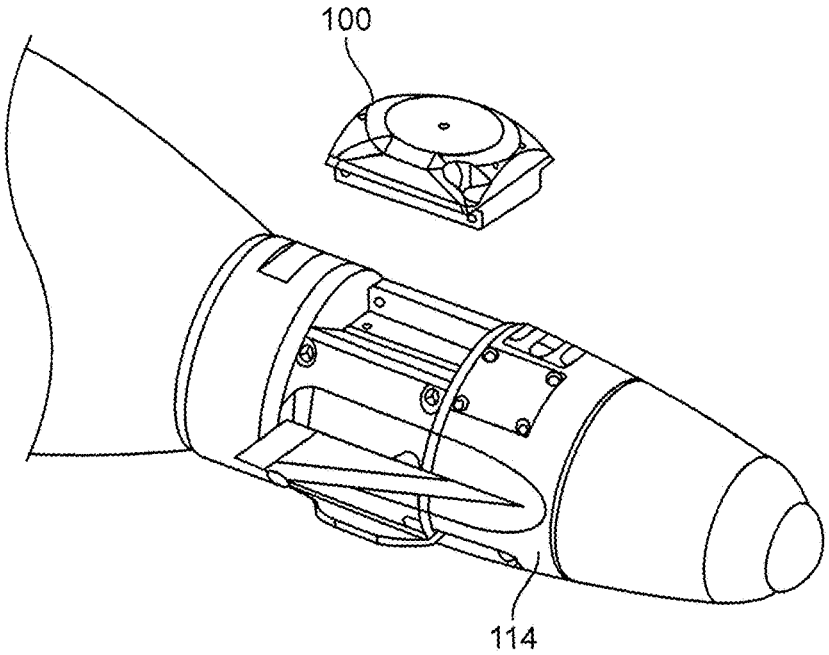
FIGS. 4A and 4B depicts how the PCPM interfaces with a guidance head or guidance unit of the projectile.
Figure 4B:
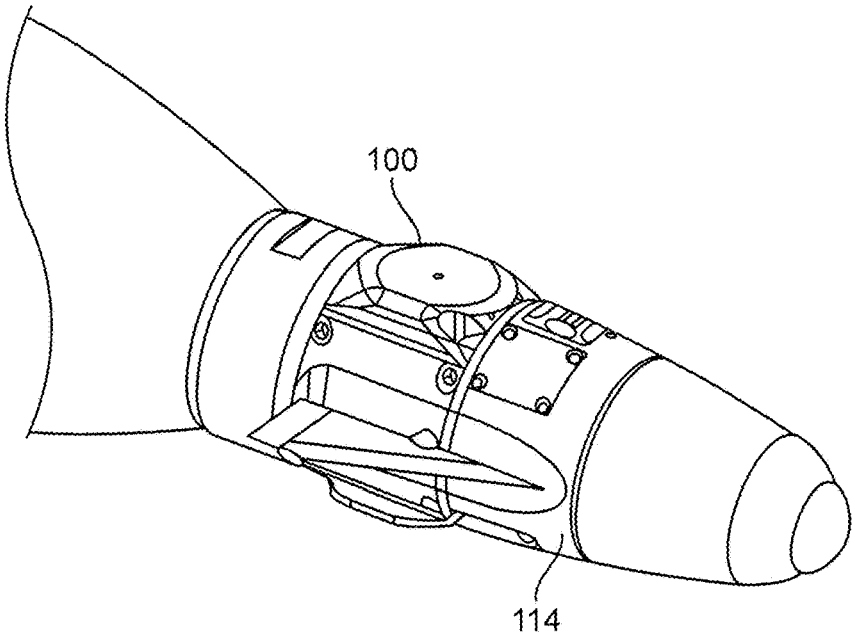

FIGS. 4A and 4B show how the PCPM (100) mechanically interfaces with a Projectile Guidance Head (PGH) (114), which can be or include a guidance unit 113 of the type described below. The PCPM is configured to be embedded into a cavity located on the surface of the PGH. FIG. 4B also shows the PCPM installed in this cavity. When installed in the cavity, the upper housing (110) (FIG. 3) of the PCPM (100) is positioned flush or semi flush with an outer housing of the airframe of the projectile and/or with an outer housing of the PGH.

Figure 5:
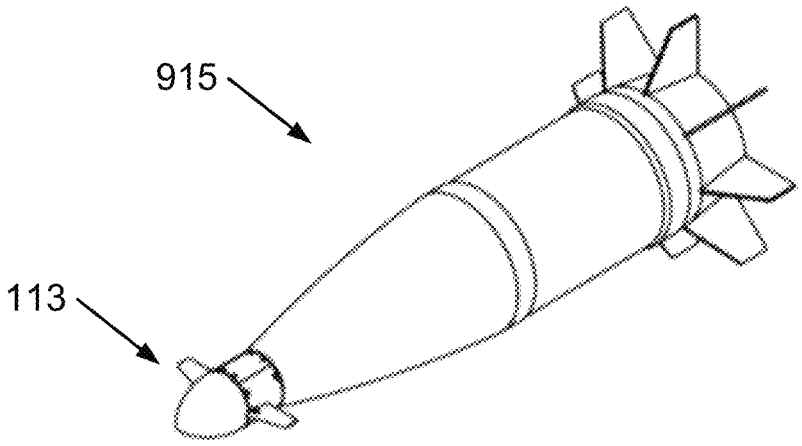
FIG. 5 shows a perspective view of an example guidance unit that couples to a projectile.
Figure 6:
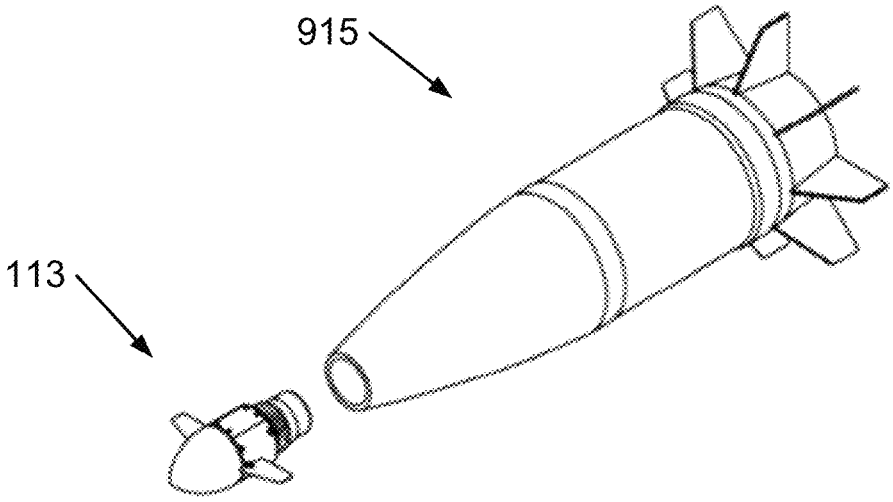
FIG. 6 shows the guidance unit uncoupled from the projectile.

FIG. 5 shows a perspective view of an exemplary nose-mounted guidance unit 113 coupled to a ground-launched projectile 915. FIG. 6 shows the guidance unit 113 uncoupled from the projectile 915. The projectile 915 is an unguided projectile in that the projectile itself does not include any components for guiding the projectile 915 to a target. As shown in FIG. 6, the guidance unit 113 attaches to the projectile 915 to convert the projectile 915 into a precision-guided projectile, as described in detail below. In the illustrated embodiment, the guidance unit 113 couples to a front-most end of the projectile 915. In this regard, the guidance unit 113 has an outer housing that forms a bullet-nosed tip such that, when coupled to the projectile 915, the guidance unit 113 and projectile 915 collectively form an aerodynamically shaped body. It should be appreciated that the shape of the projectile and of the guidance unit can vary from what is shown in the figures.

The guidance unit 113 may be equipped with a computer readable memory that is loaded with one or more software applications for controlling the guidance of the projectile 915. Moreover, the guidance unit 113 may be equipped with any of a variety of electro-mechanical components for effecting guidance and operation of the projectile. The components for effecting guidance can vary and can include, for example, a global positioning system (GPS), laser guidance system, image tracking, etc. The guidance unit 113 may also include an guidance-integrated fuse system for arming and fusing an explosive coupled to the projectile 915.

The configuration of the projectile 915 may vary. For example, the projectile 915 may be a tail-fin-stabilized projectile (TSP), such as a mortar bomb or artillery shell. Such an embodiment of a projectile includes one or more fins fixedly attached to the tail of the projectile. In another example, the projectile 915 is a spin-stabilized projectile (SSP). It should be appreciated that the projectile 915 may vary in type and configuration.

Figure 7:
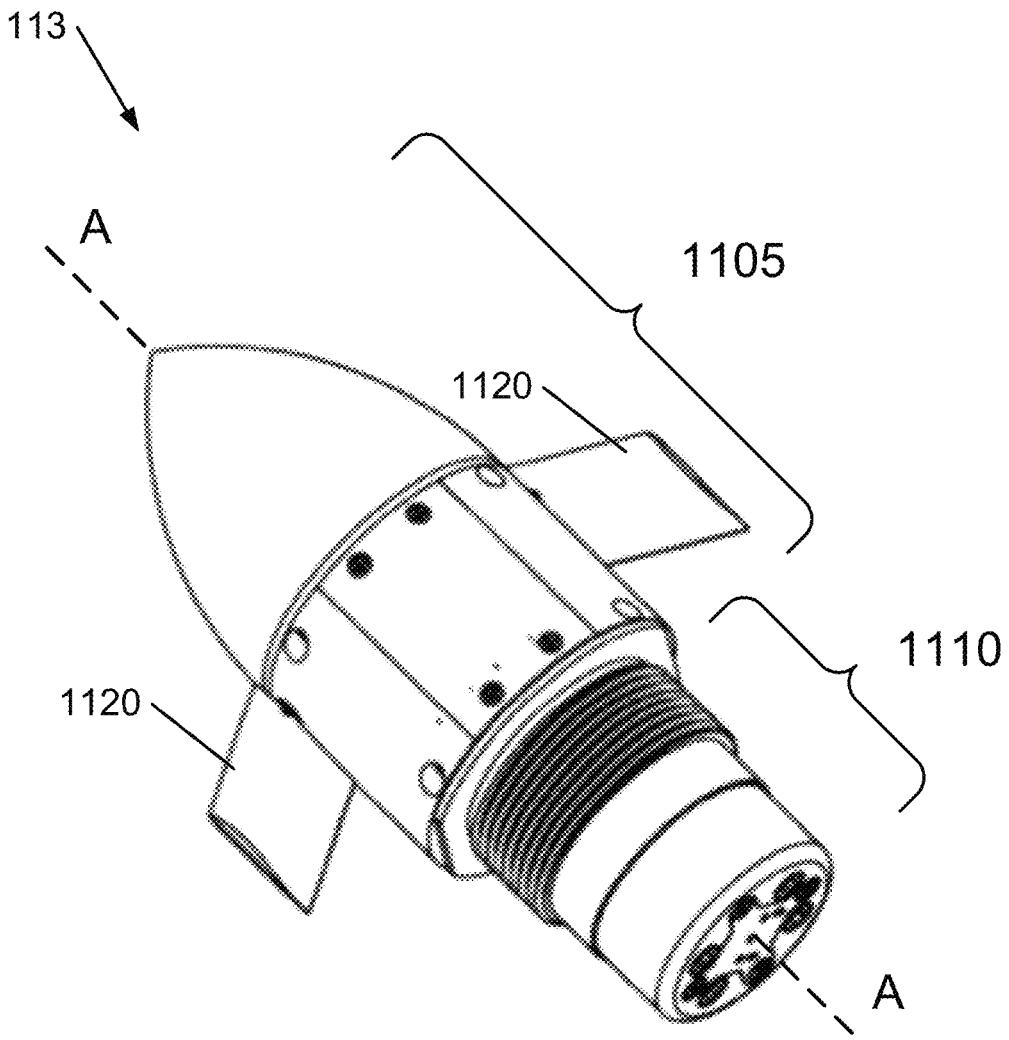
FIG. 7 shows an enlarged view of the guidance unit.

FIG. 7 shows an enlarged view of the guidance unit 113. As mentioned, the guidance unit 113 includes a front housing 1105 that forms a bullet-nosed tip although the shape may vary. A coupling region 1110 is positioned at a rear region of the guidance unit 113. The coupling region 1110 can be coupled, attached, or otherwise secured to the projectile 915 such as at a front region of the projectile. The front housing 1105 and its contents are rotatably mounted to the coupling region 1110 such that the housing 1105 (and its contents) can rotate about an axis, such as an axis perpendicular to the longitudinal axis A relative to the coupling region 1110, as described in detail below. Rotation about other axes, such as about the axis A, are also possible. The longitudinal axis extends through the center of the unit 113. In the illustrated embodiment, the coupling region 1110 has outer threads such that the coupling region can be threaded into a complementary threaded region of the projectile 915. It should be appreciated, however, that other manners of coupling the guidance unit 113 to the projectile 915 are within the scope of this disclosure.

Figure 8:
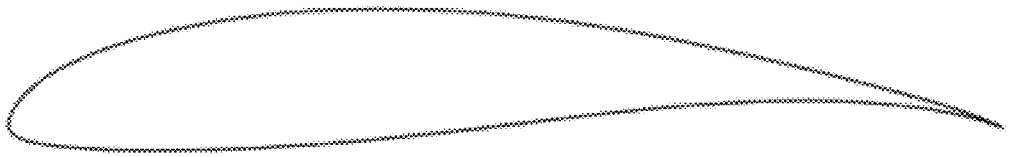
FIG. 8 shows an airfoil shape of a cambered canard.
Figure 9:
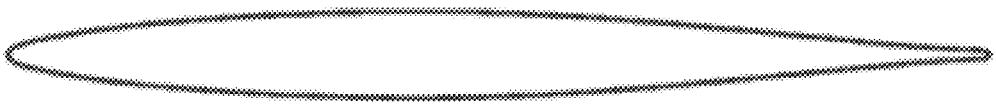
FIG. 9 shows an airfoil shape of a symmetric canard.

With reference still to FIG. 7, two or more control surfaces, such as canards 1120, are positioned on the front housing 1105 of the guidance unit 113. The canards are configured to be proportionally actuated for accurate guidance of the projectile 915 during use, as described in more detail below. That is, an internal motor in the housing 1105 is configured to move the canards in a controlled manner to provide control over a trajectory of the projectile 915. The canards 1120 are configured to aerodynamically control the roll and pitch orientation of the projectile 915 with respect to an earth reference frame. In this regard, the canards can be cambered as shown in FIG. 8 or the canards can be symmetric as shown in FIG. 9. The cambered airfoil can be used for mortar bombs and tail-fin-stabilized artillery shells, while for symmetric airfoil can be used for spin-stabilized projectiles. Any of a variety of airfoil configurations are within the scope of this disclosure.

The guidance unit 113 is configured to achieve proportional actuation in a manner that makes the guidance unit 113 capable of surviving the extremely high loads associated with a gun-launched projectile. In this regard, a motor is mounted inside the front housing within a bearing that is rigidly attached to the housing, as described below. The bearing effectively provides an inertial shield over the motor such that the motor is free to rotate relative to the mortar body about the longitudinal axis A. This configuration advantageously reduces or eliminates inertial loads that are experienced during launch and/or flight from being transferred to the motor. Without such an inertial shield, the motor can experience loads during launch that have been shown to increase the likelihood of damage or destruction of the motor.

Figure 10A:
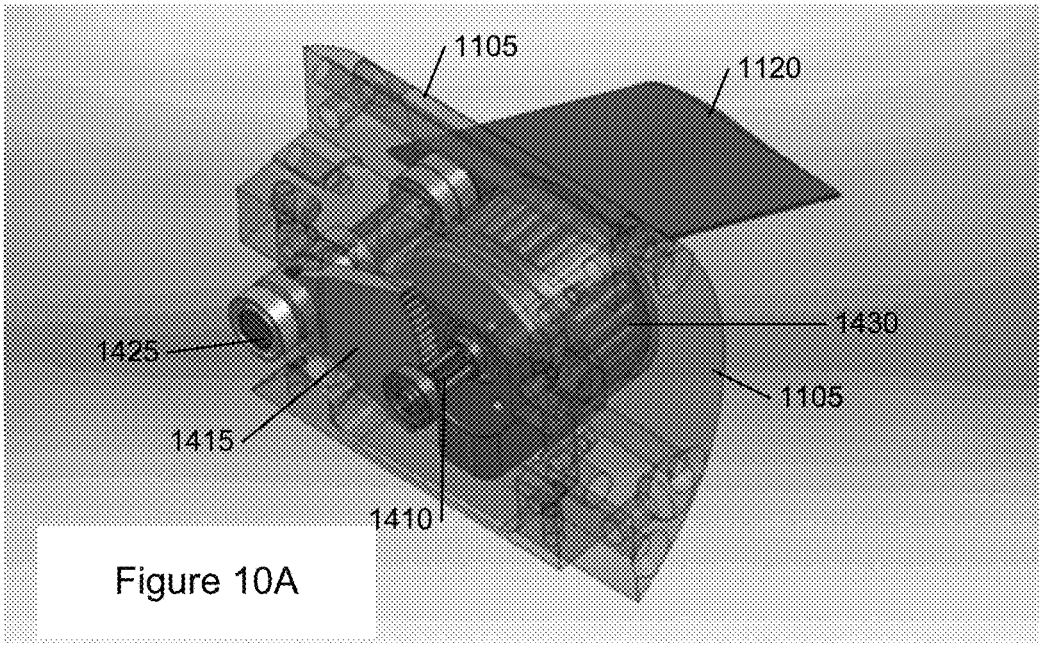
FIGS. 10A and 10B shows a perspective view of a portion of the front housing in partial cross-section.
Figure 10B:
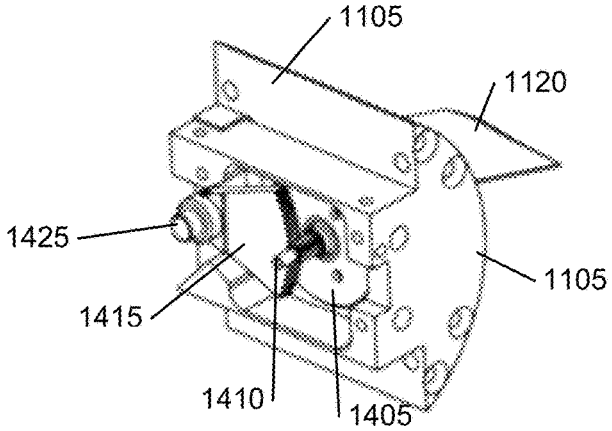

FIG. 10A shows a perspective view of a portion of the front housing 1105 of the guidance unit 113. FIG. 10A shows the guidance unit 113 in partial cross-section with a portion of the device shown in phantom for clarity of reference. FIG. 10B shows the guidance unit in partial cross-section. As discussed above, the canards 1120 are mounted on the outer housing 1105. A motor 605 is positioned inside the housing 1105 within a bearing 1430, which shields the motor 605 from inertial loads during launch, as described below. In the illustrated embodiment, the motor 605 is a flat motor although the type of motor may vary. The motor 605 drives a drive shaft 1410 by causing the drive shaft 1410 to rotate.

The motor 605 is mechanically coupled to the canards 1120 via the drive shaft 1410 and a geared plate 1415. The plate 1415 is mechanically coupled to the drive shaft 1410 via a geared teeth arrangement. In this manner, the plate 1415 translates rotational movement of the drive shaft 1410 to corresponding rotational movement of a shaft 1425. The shaft 1425 is coupled to the canards 1120. The motor 1415 can be operated to move the canards 1120 in a desired manner such as to achieve proportional actuation each canard 1120.

The motor 605 is positioned inside a bearing 1430 that is rigidly and fixedly attached to the housing 1105. That is, the bearing 1430 is attached to the housing 1105 in a manner such that any rotation of the housing 1105 is transferred to the bearing 1430. Thus, when the housing 1105 rotates, such as a result of loads experience during launch, the bearing also rotates along with the housing 1105. However, the motor 1430 does not necessarily rotate as the bearing 1430 prevents or reduces rotational movement and corresponding loads from being transferred to the motor 1430. The bearing arrangement thereby shields the motor 605 from loads on the housing 1105 during launch and ballistic movement. It has been observed that the ground-launched projectiles may experience loads on the order of 10,000 to 25,000 during launch. The configuration of the guidance unit advantageously protects the motor against such loads.

Guidance of Tail-Fin-Stabilized Projectile

As mentioned, the guidance unit 113 is configured to provide control over a TSP. In this regards, the guidance unit 113 controls a TSP using roll-to-turn guidance by differentially actuating the canards 1120 to achieve differential movement between one canard and another canard on the projectile 915. Such proportional actuation of the canards can be used to achieve a desired roll attitude while collectively actuating the canards to apply a pitching moment to achieve a desired angle of attack and lift. The cambered shape of the canard airfoil maximizes the achievable angle of attack. It has been shown that about 8 to 10 degrees of angle of attack yields maximum lift-to-draft ratio, which maximizes the projectile's glide ratio, thereby extending its range.

Guidance of Spin-Stabilized Projectile

Figure 11A:
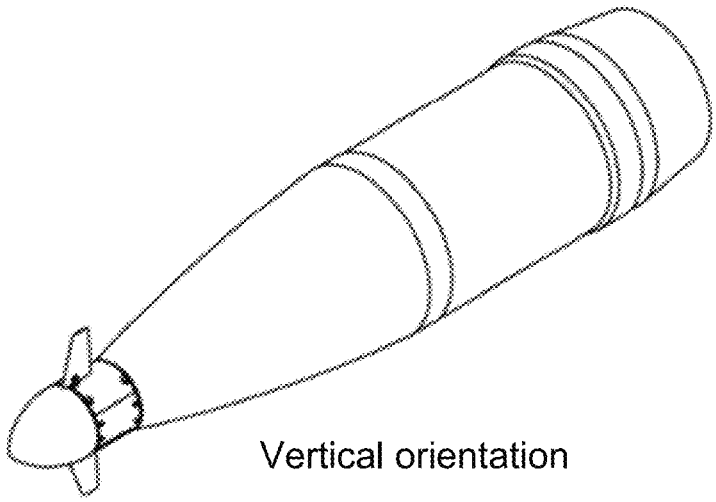
FIGS. 11A and 11B illustrates how a projectile may be guided by differential deflection of canards
Figure 11B:
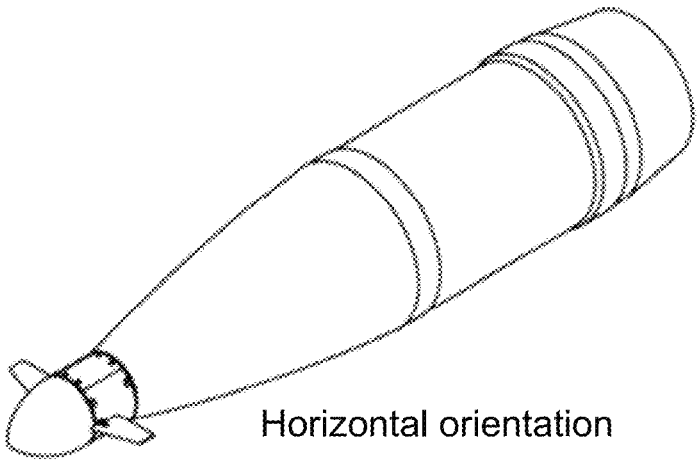

The guidance unit is further configured to provide control over a SSP. The physical hardware of the guidance unit for an SSP can be identical to that used for a TSP. As mentioned, the airfoil profile can also differ between the SSP and TSP. The guidance software used for the SSP guidance may also be configured differently. For guidance of an SSP, the guidance unit 113 is alternately oriented in a vertical and horizontal orientation, as shown in FIGS. 11A and 11B, by differential deflection of the canards. Once the guidance unit is established in one of a vertical or horizontal position, the motor 605 is operated to deflect the canards proportionally to apply the required amount of vertical or horizontal force to steer the projectile in such a manner as to continually keep it aligned along a pre-determined trajectory to the target. The amount of time spent in each of these orientations and the magnitude of the deflection during that period are determined in software according to the detected position and velocity deviations from the desired trajectory.

In use, the projectile 915 with guidance unit 113 is launched from a standard mortar tube. The guidance unit 113 controls its trajectory to the target according to guidance laws that assure optimum use of the available energy imparted at launch to reach maximum range and achieve steep-angle target engagement. It employs roll- to turn guidance to laterally steer to the target and to control the orientation of the unit relative to earth to optimize trajectory shaping in elevation During the ascent and ingress portion of the trajectory, the cambered canards are differentially deflected to establish and maintain the control unit in the upright position (roll angle=0). Collective deflection of the fins serves to cause the mortar bomb to assume an angle of attack corresponding to maximum lift-to-drag ratio, which translates into the flattest glide ratio (distance travelled to height lost) in order to maximally extend the range of the round.

This condition is maintained until the line of sight angle to the target approaches a pre-set target engagement dive angle, at which point the fins are once again differentially deflected to cause the control unit to invert (roll angle=180 degrees) and collectively deflected to cause the round to pitch down at the required angle to the target. Owing to the powerful control afforded by the high-lift cambered fins oriented in the inverted attitude, the pitch-down occurs very rapidly thereby minimizing the time and distance required to achieve the desired steep target engagement angle. Once the desired path angle is achieved, the canards roll the unit to the upright orientation and the round continues to fly to the target with the guidance unit in that attitude.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, embodiments, methods of use, and combinations thereof are also possible. Therefore the spirit and endoscope of the appended claims should not be limited to the description of the embodiments contained herein.

The invention claimed is:

1. A power system for a ground-launched projectile, comprising:

a ground-launch projectile, the projectile having an outer housing that defines an outer surface, wherein the projectile lacks a battery;

a rotatable turbine that rotates about an axis, the turbine having a plurality of blades that radiate outward from a central hub;

a power generator inside the turbine, wherein the turbine is attached to the power generator such that the power generator generates power upon rotation of the turbine;

an annular bearing that surrounds the power generator, the annular bearing being aligned about the axis;

an air inlet in the outer surface of the outer housing, wherein the air inlet directs airflow toward the turbine when the projectile is in flight and wherein the airflow causes the turbine to rotate about the axis; and an air outlet in the outer surface of the outer housing, wherein the air outlet directs exhaust airflow from the turbine out of the outer housing along a direction that is 90 degrees relative to a direction of flight of the projectile.

2. The power system of claim 1, further comprising a turbine housing that contains the turbine, the power generator and the annular bearing.

3. The power system of claim 1, wherein the air inlet is flush with the outer housing.

4. The power system of claim 1, wherein the turbine is attached to a drive shaft of the generator and wherein the turbine rotates the drive shaft upon rotation of the turbine.

5. The power system of claim 2, wherein the turbine housing is positioned at a head of the projectile.

6. The power system of claim 2, wherein the turbine housing is positioned in a guidance unit of the projectile.

7. The power system of claim 6, wherein the guidance unit comprises:

a housing, the housing having a bullet-nosed region and an attachment region, wherein the attachment region inserts into the projectile, wherein the bullet-nosed region of the housing rotates relative to the attachment region of the housing;

a motor contained within the housing;

a bearing surrounding the motor such that the motor is contained entirely within the bearing, the bearing being rigidly attached to the housing such that the motor rotates with the housing and shields the motor from inertial loads experienced by the housing, wherein the bearing rotates about an axis perpendicular to a long axis of the projectile.

* * * * *